United States Patent [19]

Hudson et al.

[11] 3,972,199

[45] Aug. 3, 1976

[54] LOW ADHESIONAL ARCTIC OFFSHORE PLATFORM

[75] Inventors: Thomas A. Hudson, San Francisco; Gordon E. Strickland, Jr., Yorba Linda, both of Calif.

[73] Assignee: Chevron Research Company, San Francisco, Calif.

[22] Filed: July 29, 1974

[21] Appl. No.: 490,174

Related U.S. Application Data

[63] Continuation-in-part of Ser. No. 266,084, June 26, 1972, Pat. No. 3,831,385.

[52] U.S. Cl. ..... 61/103; 61/1 F; 61/36 A; 62/259; 114/40

[51] Int. Cl.[2] ..... E02B 15/02; F24J 1/00

[58] Field of Search ..... 61/46.5, 46, 1, 54; 62/259, 260, 72; 114/40; 249/127, 128

[56] References Cited

UNITED STATES PATENTS

| | | | |
|---|---|---|---|
| 2,433,210 | 12/1947 | Gits | 249/127 |
| 3,448,585 | 6/1969 | Vogelsang | 61/54 |
| 3,831,385 | 8/1974 | Hudson et al. | 61/46.5 |

OTHER PUBLICATIONS

The Oil and Gas Journal of Sept. 14, 1970 pp. 60,61.

*Primary Examiner*—Jacob Shapiro
*Attorney, Agent, or Firm*—R. L. Freeland, Jr.; R. T. Kloeppel

[57] ABSTRACT

A method and apparatus for reducing ice forces on a marine structure erected in a body of water which becomes frozen through natural weather conditions. The structure has a low-ice-adhesional wall forming its perimetrical surface in the zone where natural ice will freeze onto or impinge against the structure. Enclosed chambers are built within the structure and may be in heat-transmitting relationship with the outer wall. Heat is applied to the chambers to heat and maintain the outer wall at a temperature above the melting point of the natural ice occurring in the water around it. In a preferred embodiment, the marine structure is formed with a heated wall which slopes upwardly and inwardly in the area of ice contact to provide a ramp-like surface upon which a sheet of ice will be forced with reduced friction as it moves against the structure. Thus, an edge of the sheet of ice will be prevented from strongly adhering to the structure either initially or subsequently. This sufficiently weakened ice-to-surface bond without heat or reduced heat to the outer wall allows the ice sheet to be lifted above its normal position on the water surface as the ice moves against the structure, causing the sheet to break any weak surface bond so it can be bent and fractured as it rides by the coated ramp-like surface and thereby reducing the force imposed by it on the structure. An alternate embodiment for reducing ice forces takes the form of a fully or partially coated cone or a cone made from material having low ice-adhesion properties. This embodiment may or may not be in combination with a heated surface.

11 Claims, 8 Drawing Figures

LOW ADHESIONAL ARCTIC OFFSHORE PLATFORM

RELATED APPLICATION

This application is a continuation-in-part of application Ser. No. 266,084, filed June 26, 1972, now U.S. Pat. No. 3,831,385.

BACKGROUND OF THE INVENTION

This invention relates to a marine structure for installation in waters upon which thick sheets of ice are formed during the winter season. In Arctic and Antarctic waters the winter ice normally may reach thicknesses of 6 to 10 feet or more and rafting, pressure ridges, and other accumulations may cause the thickness of the ice in places to be several times the thickness of the original sheet. The ice sheets are of vast areas; and, although normally they may move relatively slowly with wind and water currents, the mass of ice in movement can cause very high forces on a stationary structure in its path. Such ice may have a compressive strength in the range of about 650 to 1000 pounds per square inch and a structure strong enough to withstand the crushing force of the ice would necessarily be very massive and correspondingly expensive to construct.

It has been proposed heretofore that rather than build a structure strong enough to withstand the total crushing force of the ice, i.e., strong enough to permit the ice to be crushed against the structure and thus enable the sheet of ice to flow around it, the structure be built with ramp-like surfaces which would cause an edge of the moving ice sheet to be forced upwardly above its normal position on the surface of the water as it came into contact with the structure, thus bending the ice sheet and placing a tensile stress in the ice. Since the ice has a flexural strength of about 85 pounds per square inch, a correspondingly relatively smaller force is placed on the structure as the ice impinging on it fails in tension.

Several forms of structures having a sloping perimetrical wall for installation in waters where they would be exposed to the forces of moving ice are illustrated in a paper by J. V. Danys entitled "Effect of Cone-Shaped Structures on Impact Forces of Ice Floes," presented to the First International Conference on Port and Ocean Engineering under Arctic Conditions, held at the Technical University of Norway, Trondheim, Norway, during Aug. 13–30, 1971.

Another publication of interest in this respect is a paper by Ben C. Gerwick, Jr., and Ronald R. Lloyd entitled "Design and Construction Procedures for Proposed Arctic Offshore Structures," presented at the Offshore Technology Conference meeting at Houston, Texas, during Apr. 1970.

In testing in a laboratory cold room, scale models of offshore structures incorporating the above design principle to investigate the action upon them of sheet ice, it was found that the ramp-type of surface, when moving relative to the ice sheet and in contact with it, caused appreciably less force to be imposed on the platform structure than would be the case if the platform wall presented to the ice sheet was disposed vertically to it as would be the situation if, for example, a proportionately larger-diameter pile or caisson was contacted by the moving ice sheet. It was discovered, however, that this condition was true only while the ice sheet could move relative to the platform and that, as explained hereinafter, ordinarily much larger forces would be imposed on the marine structure before the bond between it and the ice was broken to permit such relative movement.

In the actual installation of a marine structure in Arctic waters, it is proposed to construct and assemble the structure in a shipyard and tow the assembled structure to the offshore site, where it will be established during the time the waters are open and relatively ice-free. At this time, the structure will be lowered into contact with the submerged earth and piles may be driven into the earth to hold the structure in place against the horizontal forces imposed upon it. Piles may also be used to assist supporting the vertical loads on the structure.

In the farther-north Arctic waters, such as the waters off the North Slope of Alaska, the open-water season is relatively short, approximately 6 weeks, after which ice begins to form on the open waters. The ice will freeze around and onto the marine structure which has been fixed at the offshore site. This condition has been duplicated in the laboratory to determine what effect the newly frozen ice sheet would have on a scale model of a ramp-sided offshore structure, as described heretofore, and particularly to determine what forces would be imposed on it.

As the ice sheet built up in thickness on the surface of the water surrounding the model structure, it also froze onto the surface of the structure in contact with the water. When the ice sheet reached the required thickness for the test, it was found that a much greater force was required to start relative motion between the model and the adhering ice sheet than was required to maintain the relative motion after the adhesional bond was broken. For the conditions of the test, approximately 5 to 10 times as much force, depending on specific conditions, was imposed on the model structure by the ice sheet before the bond was broken than was imposed after this relative motion was established.

The amount of force imposed initially on the structure by the ice sheet will, of course, be dependent on the form, dimensions and characteristics of the structure and the dimensions and characteristics of the ice. But, in all cases, as the problem is understood now, a much greater force will be imposed initially on the structure before the adhesional bond between it and the ice is broken than will be imposed after the bond is disrupted. Ordinarily it would be necessary under these conditions to build the structure strong enough to withstand the initial forces imposed on it by the ice sheet, even though the forces imposed on it during the major portion of its useful life would not require a structure of such rugged construction. A structure built strong enough to withstand the initial ice forces would be correspondingly more expensive to build and more difficult to install than one designed to take only the load of a relatively moving ice sheet. The present invention is designed to alleviate this condition of initial high loading imposed on the offshore structure by a method and apparatus to be described hereinafter.

SUMMARY OF THE INVENTION

The invention will be described hereinafter as applied particularly to an offshore structure used primarily for drilling oil wells or as an adjunct to producing oil from subaqueous oilfields in regions of the earth where the open waters become frozen on the surface with an appreciable thickness of ice. For simplicity of description, such a structure may be designated hereinafter as an offshore drilling platform, although it will be appreciated that the principles of this invention may be applied to other types of marine structures such as offshore production platform, offshore loading and unloading stations for petroleum tankers, lighthouses, piers or other structures established in a fixed location and exposed to the forces of ice sheets which move on the surface of the water.

Pursuant to the invention, a method is provided for preventing the natural ice from freezing on or strongly adhering to the surfaces of the offshore structure exposed to the water in the zone of natural ice formation, and appropriate apparatus is exemplified to accomplish this method. This method comprises a system for applying heat to the inner or outer surface of the outer wall or shell of the structure, particularly adjacent the water line, where the natural ice will tend to freeze onto or impinge against the outer surface of the shell to cause the temperature of the outer surface of the shell in the area of ice contact to be maintained above the melting point of the ice. The heating system is such that heat can be applied continuously to the shell of the platform while ice is present in the water around it, both to prevent adhesion of ice to the shell and to provide a film of water between the ice and the outer surface of the shell to assist the ice in slipping over and upon this surface when the ice contacts it, both of which features function to reduce the force imposed on the structure by the moving ice sheets. This method further provides coating the exterior of the shell with a material or coating means that reduces ice adhesion, such as halocarbon resins like tetrafluoroethylene polymer; tetrafluoroethylene hexafluoropropylene and copolymers; chlorotrifluoroethylene polymers; and nylons such as polyamide polymers or copolymers and polylactams. Other similar low or non-ice-adhering materials should not have adhesional restraint between ice and the material greater than 100 psi. For comparison, the adhesion between ice and steel can be as high as 100 psi at a temperature in the region of 20°F.

In summary, this coating is such that adhesion of ice to the platform is negligible. The coating supplants or assists the film of water described above, while at the same time reducing the adhesional bond between the ice and the material. This material functions as a backup in an emergency situation where the heating system fails and a long down-time for repairs is required. Further, this material reduces the amount of heat needed during daily operations, since the adhesional bond is significantly reduced as a result of the coatings.

In a preferred embodiment of the invention, an offshore drilling platform is constructed with a portion of its perimetrical outer wall or shell in the form of a frustum of a cone sloping upwardly and inwardly of the platform at an angle of approximately 45° to the horizontal. The conical surface extends from a location below the region of ice formation on the surface of the water to some distance above the level of the water surface. Thus, there is a lower section in the area of ice contact which slopes or converges upwardly and inwardly, a minimal middle cylindrical section which may approach zero above this area of ice contact, and an upper diverging section which slopes upwardly and outwardly. Since all of these sections are continuous, they will function somewhat in the manner of a ramp upon which an edge of a sheet of ice will be raised above its natural level on the surface of the water as the ice moves toward the platform. As a result, the ice sheet will be flexed in the region of the platform, causing the ice to fracture and break from the tensile forces resulting from the flexural stress. The conical wall is coated with low or non-ice-adhering materials. This coating feature facilitates breaking the bond of ice to the structure; additionally, it freely permits the flow of ice up the wall.

Water-tight compartments, which in the preferred embodiment function as water tanks, are constructed within the platform adjacent the outer conical shell, and the latter acts as a common exterior wall for both the platform structure and the water tanks. The tanks are connected to pumps for circulating water through them and through heat exchangers. The exchangers are in communication with the exhaust gases from the engines which generate the power for operating the machinery and other apparatus on the platform. The tanks are filled with water that is heated an amount to maintain the outer surface of the shell of the platform above the melting point of the natural ice forming around or impinging upon it, thus preventing the ice from freezing onto and adhering to the outer surface of the platform. Preferably the water tanks are of sufficient capacity to contain enough heated water to maintain the critical area of the coated shell of the platform at a temperature above the melting point of the natural ice throughout a period of at least 24 hours if no additional heat is added to the water during that time. This will provide a safe period for making repairs if the source of heat for the water should fail during the critical period when the ice sheet may otherwise be in a condition to freeze onto the platform and start moving. It will be noted that if the source of heat for the water fails during the time when the ice sheet is in motion so that the intact ice sheet does not adhere to the coated shell, any additional load imposed on the platform by the ice will be considerably less than the force imposed on the platform by the thrust of an ice sheet which is frozen onto and adhering to the coated shell.

Alternatively, the perimetrical wall may be made entirely of non or low-ice-adhering material, resulting in a substantial reduction in the force derived from breaking the ice bond. A further advantage of this embodiment is a weight savings in the structure itself, with a corresponding reduction in foundation support for the entire platform, since a structurally lighter platform results when forces on it are reduced.

The present invention also includes embodiments of the coated exterior wall and the solid perimetrical wall made from the non or low-ice-adhering material with no exterior surface heating.

It is not intended that the invention be limited to heated water tanks placed within the coated shell or shell made from low or non-adhesional material, and other means for performing the method of this invention also will be described hereinafter or will become apparent as the description of the invention proceeds in conjunction with the accompanying drawings which form part of this specification.

DESCRIPTION OF THE PREFERRED EMBODIMENT

Figure 1:
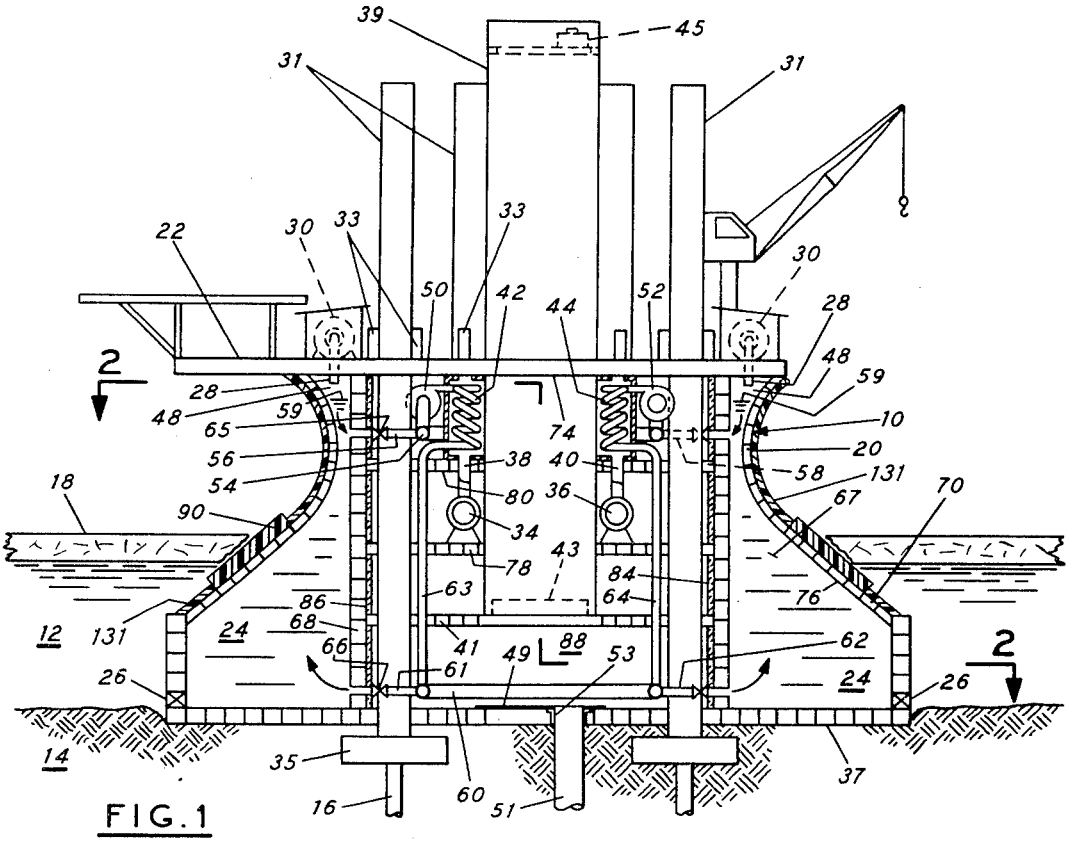
FIG. 1 is a schematic representation, partly in section and with some elements rearranged in position for clarity of disclosure, of an offshore drilling platform incorporating the features of this invention, and illustrates the embodiment which employs heated water tanks to maintain the critical areas of the coated shell of the structure above the freezing temperature of the natural ice around it.

FIG. 1 represents an offshore drilling platform 10 installed in a body of water 12 in engagement with the underwater bottom 14 to which it is secured temporarily by piles 16. The platform is designed particularly for installation in Arctic waters upon which thick sheets of ice 18 will seasonably be formed. The platform has a lower support portion 20 which extends into the water and forms a base which supports a deck portion 22 above the surface of the water in an upright position. The lower portion of the platform is exposed to the water and ice forces incident to its environment, and is the portion of the platform of principal interest to the present invention. The upper portion of the platform may contain several levels of decks and may be enclosed and heated to provide a reasonably comfortable working environment and protection for men and equipment from the winter weather, during which the temperature may drop to the range of −60°F. Without adequate heating facilities in the working areas, the operation of the Arctic drilling platform would become virtually impossible during a major portion of the year.

Since it is both expensive and difficult to construct and install a drilling platform in Arctic waters, it is desirable to provide a platform which is capable of drilling a number of wells from the same location. For example, the drilling platform illustrated in FIG. 1 may be designed to drill 10 or more wells from the same platform site to a depth of approximately 16,000 feet, and accordingly is made large enough to accommodate the machinery and equipment necessary for this purpose. By way of illustration only, a platform of this capacity for installation in 40 feet of water may have a bottom diameter of approximately 180 feet and a diameter at the water line of approximately 120 feet. The base portion may have a height of 85 feet and support above it decks and other appurtenant equipment, including a drilling derrick reaching to an elevation of approximately 160 feet above the floor of the sea.

A drilling platform of the above-mentioned dimensions will weigh several thousand tons before it receives any of the machinery and equipment necessary for the drilling operation. The weight of the platform will increase proportionately as it is designed to withstand greater natural forces; and, since the weight of the structure reflects its cost, the cost will increase proportionately as the weight increases. The present invention is directed toward a procedure for reducing the forces imposed on the base portion by natural ice formations, thus permitting less structural material to be incorporated in it and correspondingly reducing its mass as well as reducing its cost.

For a drilling platform of the size and drilling capacity referred to, power generators adequate to produce approximately 3300 horsepower will be supplied to operate the rotary table, drawworks, mud pumps and other equipment and appurtenances necessary for the drilling operation. In accordance with one exemplary embodiment of this invention, the waste heat from the power-generating source is used to heat the coated shell of the platform above the melting point of the natural ice surrounding it in the manner and for the purpose to be described in more detail hereinafter. If, for example, the power source selected is a turbine engine and three 1100-hp gas turbines are used for the power necessary to operate the drilling platform, more than 32,000,000 Btu/hr. waste heat from the turbines will be available for heating the shell of the support structure. This amount of heat is amply adequate to maintain a shell of the dimensions noted above continuously at a temperature above the melting point of the natural ice formed in the water in contact with it.

The structure illustrated in FIG. 1 represents a drilling platform which is towed to the drilling site in a completely assembled and equipped condition and which requires no additional construction at the site except for lowering it into engagement with the sea bottom and, when necessary, securing it with piles. Ballast tanks 24 (FIGS. 1 and 2) are built into the base portion 20 as an integral part of it to ballast the platform when being towed and to enable it to be lowered through the water into contact with the sea bottom. The ballast tanks are each provided with appropriate sea cocks 26 which can be manipulated remotely from aboard the platform by means not shown, but which can be provided for within the skill of the art. Each ballast tank has connected to it a respective blowdown pipe 28 which receives air under pressure from a compressor 30. The sea cocks can be opened to admit water into the ballast tanks or, alternatively, pressurized air can be introduced into the tanks to expel water from the tanks through the sea cocks.

When the platform is under tow, enough water is admitted to the ballast tanks to give it a draft of about 8 to 10 feet, and the ballast tanks have sufficient volume to provide adequate buoyant space above the ballast water to give the platform stability in its towing condition. The ballast tanks may, of course, be trimmed as necessary to compensate for any uneven distribution of weight in the platform.

The drilling platform represented by FIG. 1 is constructed to be readily established with full operating capability at a selected drilling site and with the ability to be removed from one site and established at another in operating condition without delay. To assist this mobility, it is desirable that the platform be constructed to be stabilized at an offshore location with a minimum of secondary construction operations, such as the driving of piles, being required to secure it in position against the forces it will be exposed to.

The platform is constructed with a plurality of leg members 31, which are mounted to be moved vertically relative to the body of the platform by corresponding jacking arrangements 33. The legs have expanded foot portions 35 and contain internal guides 32 (FIG. 2) for the piles 16. When the platform assembly reaches a drilling site, and while it still is floating, the leg members are lowered into engagement with the sea bottom. While the jacks are engaged with their respective legs, the sea cocks 26 are opened to admit additional water to the ballast tanks 24, increasing the weight of the platform enough to give it negative buoyancy. The footings 35 are designed to control the penetration of the legs into the sea bottom as the weight of the platform increases.

The jacks 33 are now operated to lower the platform along the legs in a leveled controlled condition until the bottom 37 of the platform is seated on the sea floor. The ballast tanks may now be flooded an additional amount, adding sufficient weight to the platform for it to resist being displaced by natural forces.

In locations where the platform will be exposed to adverse conditions such as the thrust of sheet ice, the piles 16 may be driven into the submerged earth to hold the platform securely in position against horizontal loads imposed on it. It is an object of this invention to provide means for reducing considerably the force which otherwise would be imposed on a stationary platform by an ice sheet moving against it, thus enabling a structure to be assembled which is more adaptable to the conditions of use described heretofore.

When the platform is to be moved to another location, the piles 16, if such piles have been used, are cut below the footings 35 or otherwise deteched from the platform. The compressors 30 are operated to expel water from the ballast tanks until a condition of buoyancy of the assembly is reached which will permit it to be elevated off bottom along the legs 31 under controlled conditions. Preferably during this operation, sufficient water will be kept in the ballast tanks to give the platform some negative buoyancy, and it will be lifted along th legs by the operation of and under control of the jacks 33. The platform is raised to its floating position, the ballast is adjusted, and the assembly is towed to its new location, where it is again set on bottom as described heretofore.

FIG. 1 represents the drilling platform installed at the drilling site and equipped for the drilling operation. The derrick, indicated at 39, is enclosed for protection from the weather and extends into the body of the structure to a deck 41, which contains a support 43 for the rotary table. The derrick has a crown block 45 which can be shifted to be aligned vertically with each of the several positions 47, FIG. 2, on bottom plate 49, through which separate wells may be drilled. The rotary table, not shown, likewise is constructed to be moved into alignment selectively with each of the positions 47. When a well is being drilled, a casing 51 is set into the well bore and sealed with a water-tight connection 53 to the plate 49. If the platform is to be moved to another location, the casing will be detached from the platform and a water-tight cover will be secured over the corresponding opening.

As previously indicated, gas turbines may be used as the primary source of power for the platform. Two of the power-generating gas turbines 34 and 36 are illustrated schematically in form and position in FIG. 1. The exhaust from each turbine is led through a respective conduit 38 and 40 to heat exchangers as represented by the coils 42 and 44. It is within the concept of this invention to provide a bank of heat exchangers which will be in communication with the exhaust ducts of all the power turbines or to provide separate heat exchangers associated with each respective power turbine. However, it is important that there be some redundancy in this portion of the apparatus to provide adequate operating heat-exchanger capacity, if some portion of the power-generating or heat-exchanger apparatus must be closed down for maintenance or repair. The perimetrical wall also has a coating made from material which reduces ice adhesion and permits a corresponding reduction in heating capacity, since the adhesional force between the coating and ice is less. A further advantage of the coating 131, directly related to its non-adhesional characteristics, is its minimal resistance to ice movement over it. The coating is either mechanically or chemically bonded to the shell.

In this illustrative embodiment of the invention, after the drilling platform is established in operating condition the ballast tanks 24 are substantially filled with a heat-transfer liquid. Atmospheric space 48 is left at the top of the tanks to function as a surge chamber and to provide for expansion of the liquid. Otherwise, the ballast tanks may be connected to auxiliary surge tanks, not shown, for this purpose.

The heat-transfer fluid may be sea water to which an appropriate corrosion inhibitor has been added to protect the steel surfaces in contact with it. Desirably an antifreeze component is added to the water to prevent it from freezing solid within the ballast tanks and to cause it to remain pumpable if the water is not heated during a period when the shell of the support structure is reduced below the freezing point. Where fresh water is available in sufficient quantity, the ballast tanks may be purged of any salt water they contain and filled with fresh water to which is added a corrosion inhibitor, an antifreeze component and an algicide to make up a compounded heat-transfer fluid.

Antifreeze components available for this purpose would be, for example, soluble salts such as sodium chloride and calcium chloride, an alcohol such as methanol, or a glycol such as ethylene glycol, or a glycerol, or any of several other antifreeze substances which are well known, any of which may be added to the water in the ballast tanks in a sufficient amount to prevent the water from freezing to a nonpumpable condition throughout a predetermined temperature range at a time when heat is not being applied to the water. A corrosion inhibitor is selected to be compatible and effective with the chosen antifreeze component.

The heat exchangers 42 and 44 are connected by appropriate pumps, as 50 and 52, respectively, to a common manifold 54 from which respective conduits, as 56 and 58, communicate with the top portion of each individual tank 24 below the level 59 of the water contained in it. The lower portion of each tank is in communication with a common manifold 60 through respective lower conduits, as 61 and 62. The heat exchangers 42 and 44 are connected to manifold 60, as by respective conduits 63 and 64, and the pumps operate to draw cooler water from the top portion of the tanks and pump it through the heat exchangers and thence into the bottom manifold 60, from which it is directed into the bottom portion of the tanks 24. Although a single pump may be used for circulating the heat-transfer fluid through the tanks 24, it is advisable to have at least a second pump connected in the system, either as an operating component or as standby, to insure the continued operation of the system if one of the units should fail to function. Appropriate valves placed in the upper and lower conduits such as, respectively, valve 65 in conduit 56 and valve 66 in conduit 61, provide a means for controlling the flow of heat-transfer fluid through an individual tank independently of the flow through adjoining tanks and also provide a means for isolating an individual tank from the heat-transfer fluid circulating system as may be necessary for repair or maintenance.

The ballast tanks for a platform of the dimensions described heretofore are designed to hold in excess of a total of 20,000 barrels of water. The heat-transfer fluid circulating system is designed to circulate fluid through these tanks at the rate of approximately 800 gallons per minute when the platform is in normal operation, and 32,000,000 Btu/hr. will be available from the power-generating turbines to heat this fluid. When the fluid in the ballast tanks is heated sufficiently to maintain the outer surface of the support structure shell at approximtely 33°F., there will be enough heat stored in the water in the ballast tanks to keep the shell above the freezing point of the ambient water for a period of 24 hours, thus providing a safe period for repairs, or for securing the wells and abandoning the platform if the power-generating system on it should fail under conditions which imperil the safety of the platform.

Figure 2:
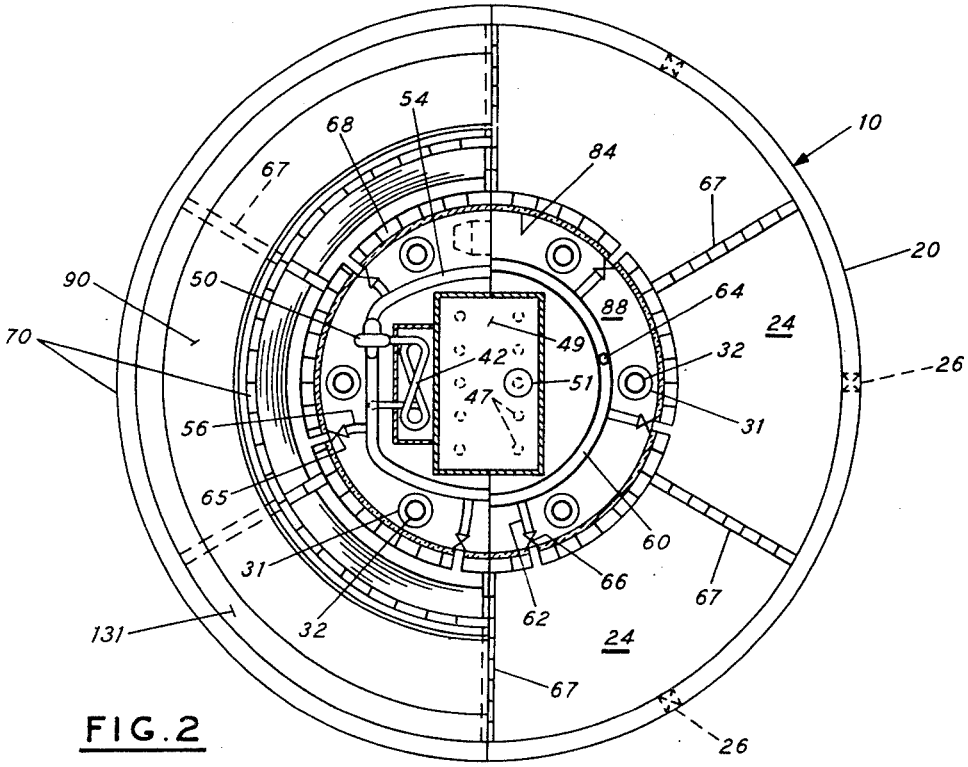
FIG. 2 is a schematic illustration in sectional plan view taken on the line 2—2 of FIG. 1.

The platform shown in FIGS. 1 and 2 indicates, by way of example, six ballast tanks 24. However, this is not a critical number, and more or fewer tanks may be appropriate for particular platforms. The tanks illustrated are separated by radially disposed water-tight walls or bulkheads 67 and are closed on their radially inwardly sides by a cylindrical wall or bulkhead 68. The radially outer wall of the tanks is the perimetrical wall or shell 70 of the lower portion 20 of the platform.

FIG. 1 also indicates the ballast tanks as extending from the water-tight bottom 37 of the platform up to the bottom deck 74 of the upper portion 22, with the heat-transfer fluid in the ballast tanks in direct heat-transfer contact with the inner surface 76 of outer wall 70 throughout substantially all of this region. However, for some platforms, it will be sufficient to provide tanks for heat-exchange fluid which, although of adequate capacity, are of less volume than those indicated in the drawings. Such smaller tanks will be distributed around the inner surface 76 of the wall 70 and be constructed to expose the inner surface to contact with the heat-exchange fluid throughout the area where natural ice could freeze to the shell, extending for a distance above and below the surface level of the ambient water, to maintain this zone of the shell above the melting temperature of the natural ice in contact with it. By this construction a weighted dry ballast may be used which requires less space than water ballast and thus provides additional dry working area within the platform.

In the illustrated embodiment, the cylindrical bulkhead 68 defines working space at the core of the platform and appropriate decks, as 41, 78 and 80, are provided to support men and machinery. Although this space will be heated to a comfortable working temperatue, which normally may be above the temperature of the fluid in the tanks 24, there is nevertheless provided a layer of insulation 84 placed against the radially inner surface 86 of bulkhead 68 to reduce heat loss from these tanks if the temperature of the core area 88 should be below that of the tanks.

Preferably a wear plate 90 of a material that reduces ice adhesion is secured to the outer surface of the shell in the zone on the platform of ice contact to strengthen this area and to receive the impact and abrasive action of the ice sheet bearing against the support structure. Because of the non or low-ice-adhesional nature of the wear plate 90, the adherence of the ice to the shell is minimal in this area.

Figure 3:
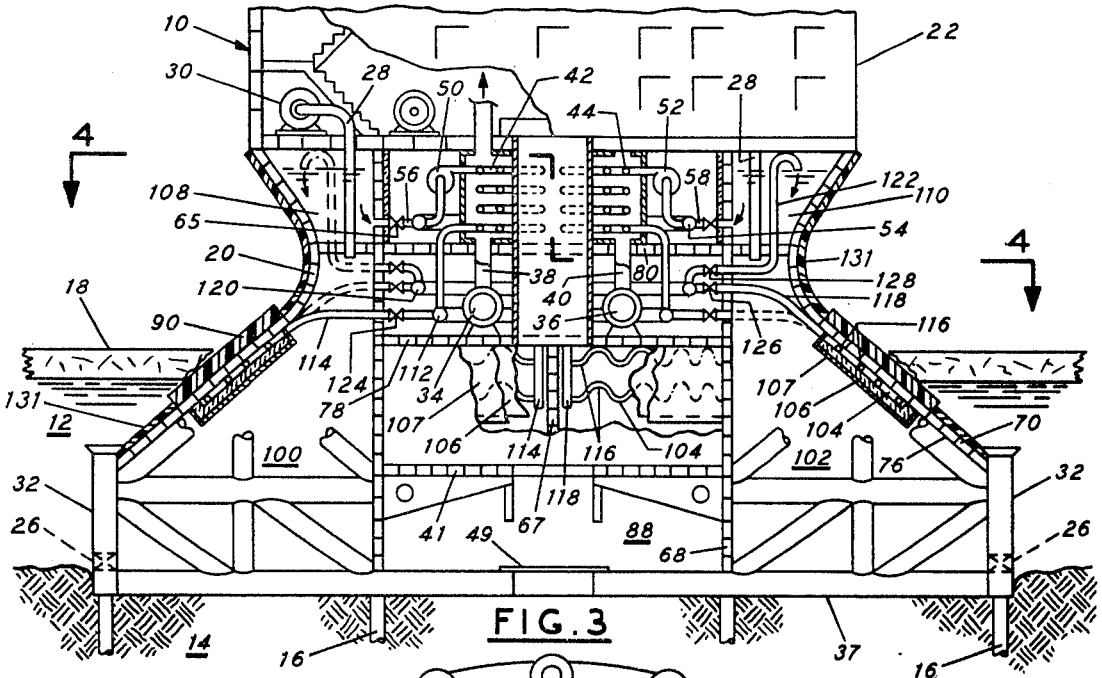
FIG. 3 is a schematic representation in elevation and partly in section of another arrangement of apparatus incorporating the features of this invention, and illustrates the use of heat-transfer panels to heat the critical area of the coated perimetrical shell of an offshore structure above the melting point of the natural ice surrounding it.
Figure 4:
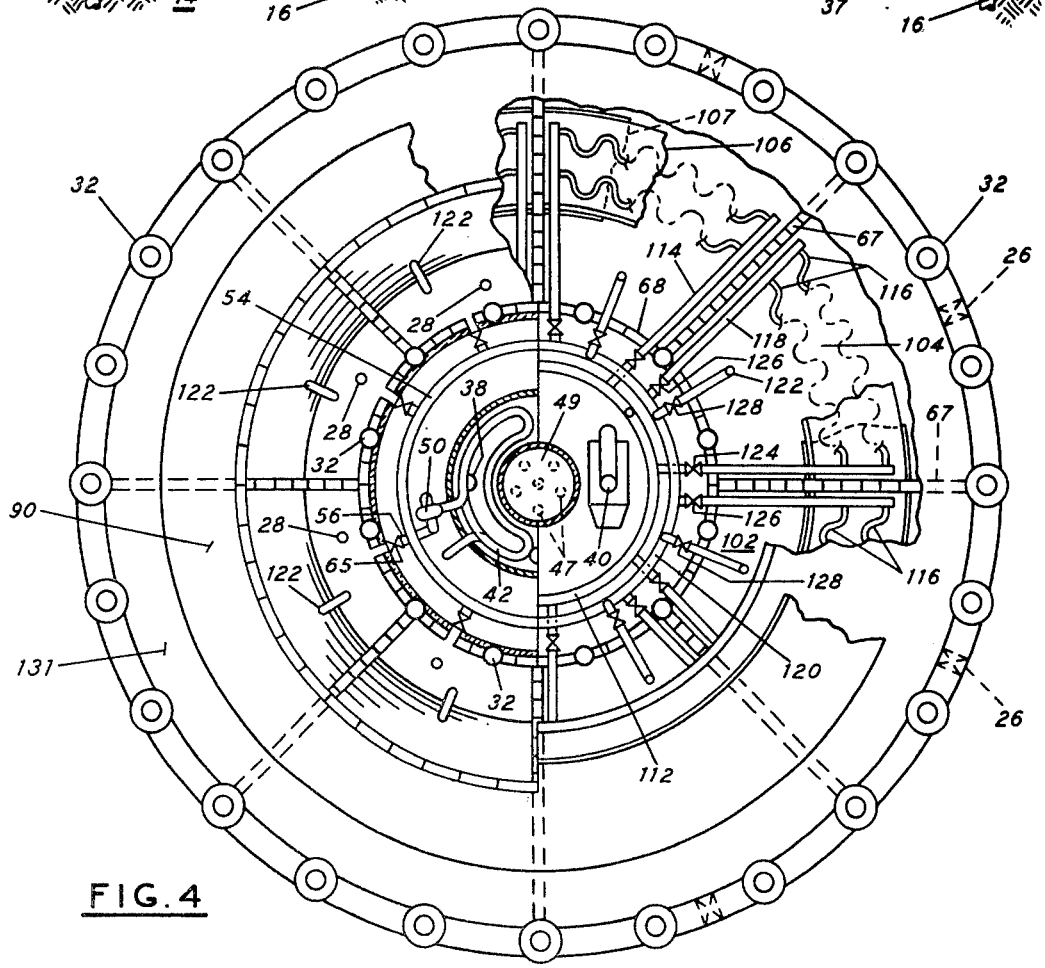
FIG. 4 is a schematic illustration in plan view and partly in section taken along the line 4—4 of FIG. 3, with portions broken away to expose details of the assembly.

FIGS. 3 and 4 represent an alternative arrangement of apparatus embodying the present invention and indicate also a modified form of platform to which it is applied. The same numerals as used previously will be used again where applicable in relation to FIGS. 3 and 4 to designate corresponding elements.

In this modification the lower support portion 20 and the upper deck 22 may be constructed as separate units which will be assembled together at the offshore site. The support portion has pile guides 32 built into it around its periphery, as well as through its central section, to receive a corresponding number of piles 16.

The support portion of the platform is towed to a chosen offshore location and sunk into contact with the sea bottom by increasing the ballast weight. Piles 16 are then inserted through the pile guides 32 and driven into the submerged earth. The support section is leveled and the piles are grouted to the pile guides to hold the platform securely in position against the horizontal and vertical loads imposed on it. Subsequently, the upper deck portion 22 is lightered to the location and assembled on the stabilized lower portion.

In this modification, as in the platform illustrated in FIG. 1, a water-tight bulkhead 68 surrounds the central area 88 of the platform and defines the inner wall of compartments 100 and 102, which may be used as ballast tanks for trimming the platform under tow and for sinking it at the well site in the manner described heretofore. However, rather than filling the compartments with the heat-transfer fluid to keep the shell of the support section above the freezing point of the ambient water, panels of coils of tubing are fitted to the inner surface of the shell in heat-transfer relationship and the panels are manifolded together to receive the heat-transfer fluid from heat exchangers which are exposed to the exhaust gases of the power-generating turbines for the platform in a manner similar to that described heretofore. In this modification of the invention, after the drilling platform has been secured to the under-water bottom, the water may be displaced from the individual compartments. The compartments are then loaded with sufficient dry weighting material to compensate for whatever residual buoyancy the assembled platform may have. This procedure reduces the corrosion problem of the interior surfaces of the compartments caused by water contained in the tankage and also provides additional dry working or storage space within the confines of the platform.

Still referring to FIG. 3, the heating panels 104 are placed against the interior surface 76 of the shell 70 with coating 131 in heat-transferring relationship throughout the area which will be in contact with the ice sheet 18 formed on the surface of the ambient water, and preferably will extend for some distance above and below the thickness of the sheet to assure that this area of the coated shell will be elevated in temperature above the melting point of the surrounding ice. A wear plate 90, preferably made from material that reduces ice adhesion, is secured to the outer surface of the shell in this area for the purpose described heretofore. The panels of heating coils are covered on their inward surfaces with a layer of insuating material 106, for example such as a foamed urethane, to confine the heat from the panels to the shell of the platform in this area. Preferably the insulating material is in turn covered by a cover 107 secured in a water-tight manner to the surface 76 to prevent water in the ballast tanks from contacting the heating panels and the insulation.

In operation, a heat-transfer fluid of the type described heretofore flows from surge tanks, as 108 and 110, into a manifold 54 from which it is taken by pumps 50 and 52. The pumps deliver the fluid to heat exchangers 42 and 44, which receive heat from the exhaust gases of the platform power-generating engines 34 and 36 through ducts 38 and 40. The fluid flows from the heat exchangers to a manifold 112, and from the manifold respective conduits 114 conduct the fluid to the heat-transfer panels 104. The fluid is pumped through the tubing 116 of the panels and thence flows through respective conduits 118 into a manifold 120, from which it is conducted by piping 122 to the respective surge tanks, as 108 and 110.

Appropriate valving is placed in the system to provide for the control of the fluid circulation to any one of the panel sections or to any surge tank and to enable these portions of the apparatus to be taken out of the operating system for maintenance or repair. Thus, respective valves 124 are placed in the conduits 114 from the manifold 112 to the corresponding sections of the heat-transfer panels 104 and respective valves 126 are placed in the conduits 118 carrying the return fluid from the heat-transfer panels to the manifold 120. In like manner, each section of the surge tankage can be isolated independently of the others by a respective valve 128 placed in the piping 122 which leads from the manifold 120 to the surge chamber, and by a corresponding respective valve 65 in the conduits, as 56 and 58, from the individual surge chamber, as 108 and 110, to the manifold 54.

Since in the modification illustrated in FIG. 3 the heat for the shell 70 of the support section of the platform is concentrated in the zone of ice formation in the surrounding water, less total heat will be required to maintain this portion of the coated shell above the melting point of the natural ice than was used for the modification of the invention described in relation to FIG. 1, and less heat-generating capacity will be required for this purpose.

It is within the concept of this invention that, under some conditions of ambient weather and platform configuration, the coated shell of the platform in the zone thereon of ice formation can be heated above the melting point of the ice by diverting the exhaust gaseous fluids from the power-generating engines through appropriate ducting into heat-transferring contact with the inner surface of the shell to function as the heat-transfer fluid. Also, it is within the concept of this invention to provide sufficient power-generating means aboard the platform to generate power for panels of electrical heating elements arranged in a manner similar to that described with reference to the heat-transfer panels illustrated in FIGS. 3 and 4.

Figure 5:
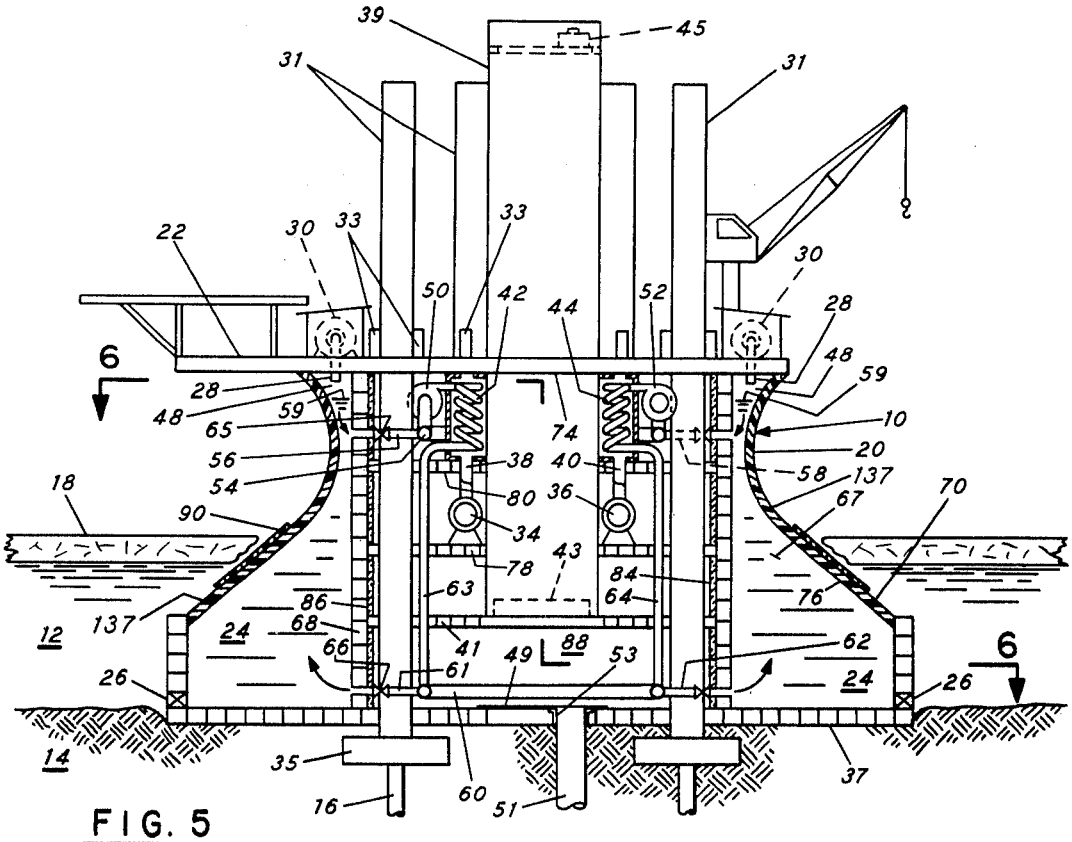
FIG. 5 is a schematic illustration of a marine platform composed of an outer shell made from low or non-ice-adhesional material.
Figure 6:
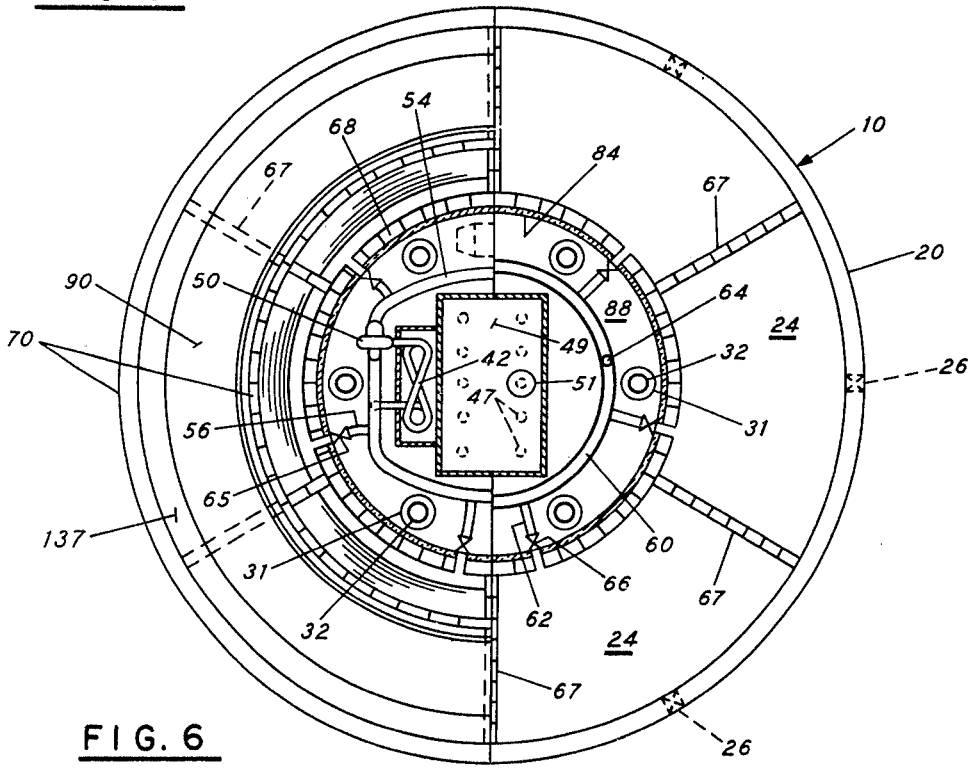
FIG. 6 is a schematic illustration in plan view and partly in section taken along line 6—6 of FIG. 5, with portions broken away to expose details of the assembly.

The schematic illustrations of FIGS. 5 and 6 depict a platform whose outer shell is made wholly from a material 137 that minimizes ice adhesion to it. Such materials may be halocarbon resins like tetrafluoroethylene hexafluoropropylene copolymers, tetrafluoroethylene polymers, chlorotrifluoroethylene polymers, or nylons like polyamide polymers or copolymers and polylactams. The platform may also have a heated exterior surface, although heating the surface is not necessary. If heating is used, either the heating apparatus illustrated in FIGS. 5 and 6 or the heating system similar to that shown in FIG. 3 can be used. The heating system can function in this modification as a backup to the non-adhesional outer shell 137.

Figure 7:
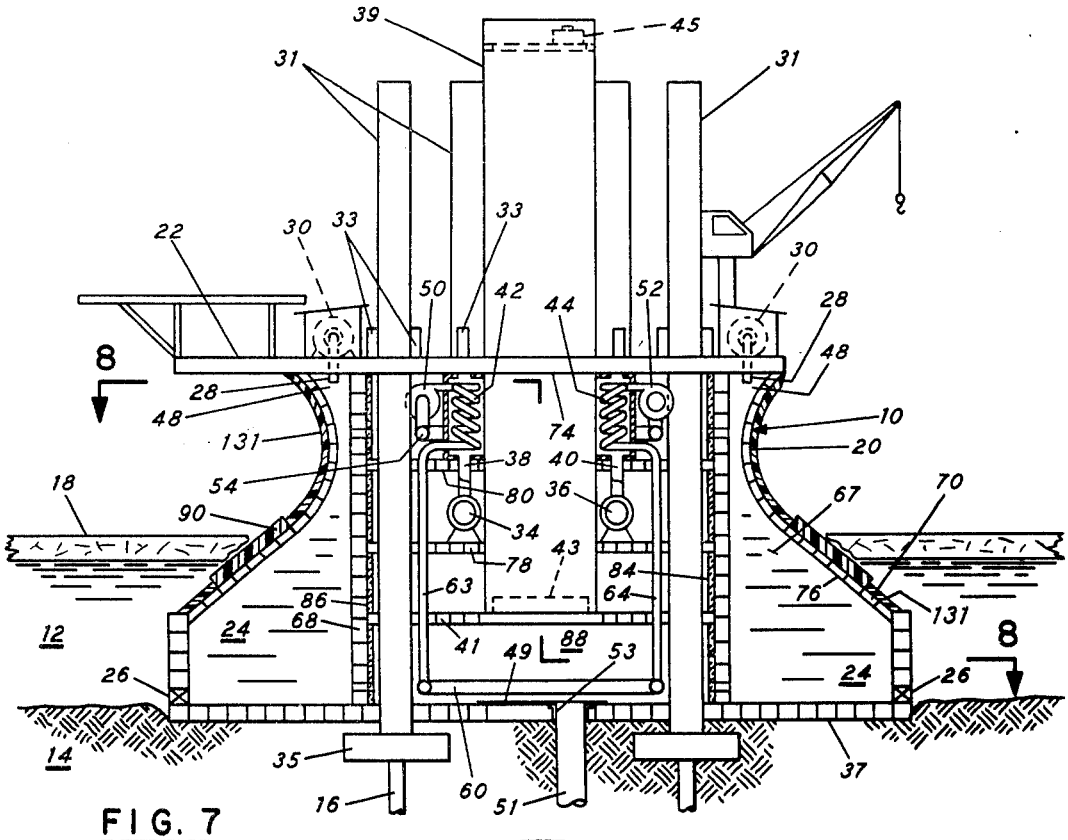
FIG. 7 is a schematic representation, partly in section, of an offshore drilling platform having the feature of a coated exterior surface. No exterior surface heating is provided; however, internal heating for platform personnel is shown.
Figure 8:
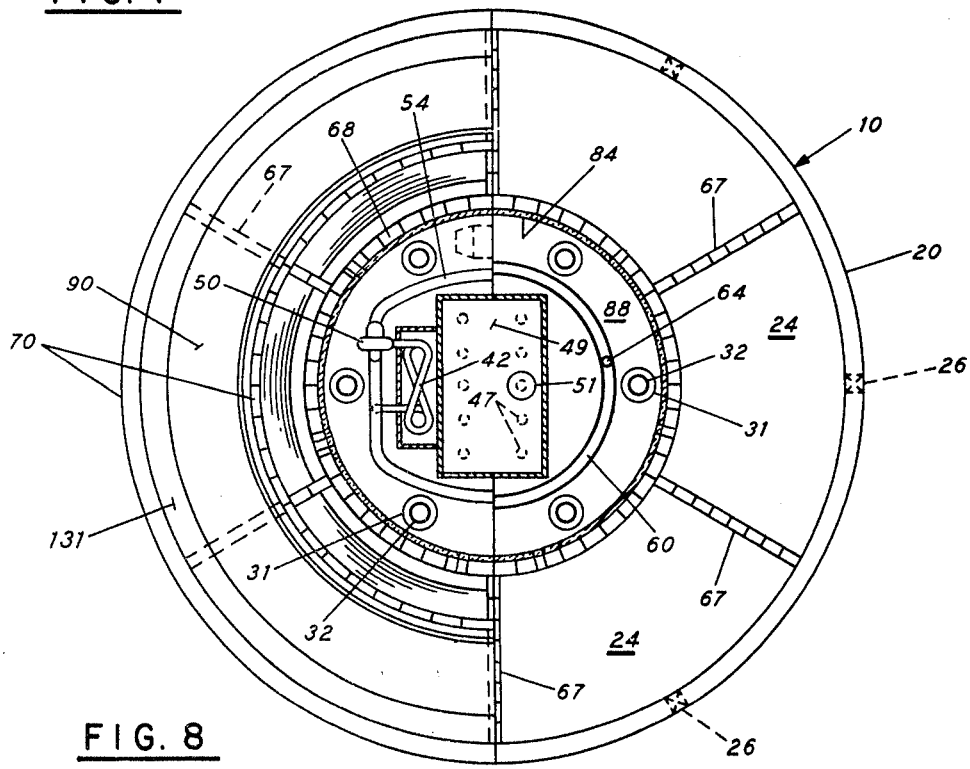
FIG. 8 is a diagrammatic representation in plan view and partly in section taken along line 8—8 of FIG. 7, with portions broken away to expose details of the assembly.

Referring particularly to FIGS. 7 and 8, an embodiment of a platform without heating the exterior wall surface of the platform is illustrated. In this embodiment, the ballast tanks 24 are either filled with a mixture of sea water and antifreeze or minimally heated in order to avoid freezing the ballast water in them. The heat exchangers 42 and 44 which are connected by appropriate pumps 50 and 52 and conduits 63 and 64 distribute heat within the area enclosed by the coated shell 70, which is used by platform personnel. A beneficial consequence of this arrangement is cost savings in piping, fuel and heating apparatus needed to transfer heat to the outer shell surface.

If it is desired to keep the platform on location after the drilling operations are completed, when it no longer is necessary to generate the amount of power required for drilling, auxiliary sources of power may be used directly to supply the heat necessary to prevent ice from adhering to it. Thus, a steam boiler may be used which is designed primarily to supply the heat transfer fluid for the ballast tanks 24 or for the heating panels 104, or the heat may be supplied by a power source external to the platform, as by connecting panels 104 of electrical heating elements to a source of electrical power generated apart from the platform.

The inventive concept is directed to the method and appropriate apparatus for reducing the forces imposed by natural ice on an offshore platform. For platforms of the dimensions recited in the specification, by way of example, the force imposed on such a platform by the movement of a sheet of ice 8 feet thick frozen on and adhering to its steel shell will be approximately 10,000,000 to 20,000,000 pounds total. When the shell is coated and heated above the melting point of the ice and the adhesion is broken, the force of the ice sheet upon the platform will be reduced in the order of five to ten times for a total force of approximately 2,000,000 pounds.

Preferred embodiments of this invention and modifications thereof have been described herein. However, it is apparent that other modifications may be made to the exemplary arrangements of apparatus disclosed herein without departing from the inventive concept, and it is intended that the invention include all of the modifications and equivalents within the scope of the appended claims.

What is claimed is:

1. A method for reducing ice forces on a marine structure established in a fixed condition in a body of water which becomes frozen through ambient natural conditions, comprising:

forming an enclosed chamber in said marine structure at a position on said structure at which an exterior surface of a wall portion of said chamber will be in contact with said water and in an area on said structure of potential contact with ice caused by natural freezing of said water, disposing said exterior surface of said wall portion at an angle inclined to the surface of said water to form a sloping, ramp-like surface to receive and elevate above its natural level an edge portion of a sheet of ice as said sheet of ice moves into contact with said surface, coating said exterior surface with a material having an adhesion between ice and the surface of said material of between zero and 100 psi, placing a controllable source of heat in communication with the interior of said chamber, heating the interior of said chamber an amount at least sufficient to cause the temperature of the coated exterior surface to be above the melting point of natural ice formed in said water adjacent said structure, and controlling the heat of said interior to maintain said temperature of said coated exterior surface above said melting point as said ambient conditions at the location of said structure change, thereby substantially reducing the adhesion of said ice freezing onto said coated exterior surface under reduced heat conditions, and thus reducing the force exerted on said fixed structure surface by a relative movement of said ice which is in contact with the coated exterior surface and assisting the ice in slipping over and upon said coated surface, and further having a minimum resistance to ice movement as said movement of said sheet of ice is continued.

2. A method for preventing ice from adhering to a selected surface of a marine structure established in a fixed condition at a location in a body of water which becomes frozen through ambient natural conditions, comprising:

forming an outer wall for said structure at a position which will be in contact with said water in a zone of natural freezing of said water, disposing said outer wall at an angle to the surface of said water to form a wall sloping upwardly and inwardly at least throughout the region of said zone and sloping upwardly and outwardly above said zone, constructing said sloping wall throughout the region of said zone to receive an edge portion of a sheet of ice which moves against said wall, said wall being formed of a material which transmits heat and having an interior surface exposed within said structure and an exterior surface in contact with said water, installing a coating on said outer wall having adhesion properties between ice and said coating of between zero and 90 psi, heating said interior surface of said wall by means of a source of heat generated on said structure, and controlling said heat to maintain said exterior surface of said wall above the melting point of ice formed naturally in said water adjacent said structure as the weather conditions at the location of said structure change to provide a film of water between said wall and said ice in contact with said wall portion, said film of water providing a means for reducing the force imposed on said structure by said ice as said ice moves upon said structure in engagement with said wall, and whereby said coating maintains non-adhesional qualities of said wall during extended periods when the step of heating is inadequate to prevent freezing of ice to said coating.

3. A method for reducing the force imposed on a marine structure established in a relatively fixed location by the movement against it of a sheet of ice present in the water adjacent said structure, comprising:

constructing said structure with an outer surface which is sloped inwardly and upwardly of said structure in the area of initial contact with an ice sheet present in said water and outwardly and upwardly above said area of initial contact with said ice sheet so that said outer surface functions as a ramp to cause a portion of a sheet of ice which moves against said structure to be lifted and bent from its normal position on said water, coating said outer surface of said structure with a coat of low-ice-adhesional material to minimize ice adhesion and facilitate ice movement over said outer surface whereby the lateral force of said sheet of ice against said marine structure is reduced independent of mechanical flexing of said surface or maintenance of a water film thereon by the application of heat to said surface from within said structure.

4. A marine structure constructed to be maintained in a fixed position in a body of water which becomes frozen through natural conditions, comprising:

a support portion of said structure, said support portion extending into a body of water and supporting a work platform above the surface of said water, a perimetrical wall of said support portion in contact with said water and extending from below the surface of said water to above said surface, said wall constructed to be disposed at an angle inclined to said surface of said water to provide a ramp-like surface to receive a sheet of ice moving relative to and in contact with said structure, at least one circumferentially disposed chamber within said support structure with said perimetrical wall forming the outer wall of said chamber, means for circulating a heat-transfer fluid through said chamber, means for reducing the adhesion between said wall and said ice sheet, and means on said structure for heating said circulating heat-transfer fluid in an amount sufficient to maintain the temperature of said perimetrical wall above the melting temperature of natural ice occurring in said body of water adjacent said wall.

5. Means for reducing the effect of ice forces on a structure established and maintained in a fixed position in an open-sea environment, which sea becomes frozen at the surface through natural conditions, comprising:

a marine structure positioned in an open-sea environment in fixed relationship to the bottom of the sea, a perimetrical wall made from a low-ice-adhesional material on said structure so as to supplant or assist a film of water adjacent to said wall, a selected lower area of said wall being formed of a material which readily transmits heat, an outer surface of said lower selected area of wall positioned to be in contact with the ice of said sea, and disposed at an inclined angle to the surface of said water in a position to receive and support an edge portion of a sheet of ice which continuously moves into contact with said selected area and to elevate said edge portion above its natural level an amount to cause said sheet of ice to fracture continuously adjacent said structure, an inner surface of said selected area of wall, means for excluding said sea from contact with said inner surface, said lower selected area of wall extending upwardly and inwardly from below the surface of said sea to above said surface at least throughout a zone of natural freezing of said water, a middle cylindrical area continuous with said lower area of said wall, an upper area sloping outwardly and upwardly and continuous with said middle area of said wall, a source of heat on said structure, and means for applying heat from said source to said inner surface of said selected area of wall in an amount to reduce the adhesion of said outer surface and said ice so that said means for applying heat can generate a film of water between said outer surface and said ice.

6. Means for reducing the effect of ice forces in accordance with claim 5 in which the lower selected area of said perimetrical wall is sloped upwardly and inwardly of said structure at an angle of approximately 45° to the horizontal to provide a ramp-like surface to receive and elevate above its natural level on said sea a portion of a sheet of ice which moves against said structure, thereby to cause said sheet of ice to bend and break adjacent said wall.

7. An offshore drilling platform for use in a body of water which becomes frozen through natural conditions, comprising:

a supporting base portion constructed to be installed in a relatively fixed position in a body of water, platform decks supported by said portion above the surface of said water, a circumferential wall on said base portion with at least a portion of said wall being made watertight and with a frustoconical form converging upwardly of said drilling platform and extending from a location below the surface of said water to a location above said surface, ballast compartments within said base portion, said base portion constructed with sufficient bouyant capacity to maintain said drilling platform in a floating condition to permit said platform to be towed through said water, means for admitting ballast into said ballast compartments to decrease said buoyant capacity an amount to cause said drilling platform to be lowered into contact with the underwater bottom, means for displacing ballast from said ballast compartments, and coating means on said circumferential wall for reducing the adhesion between ice and said coating means and for assisting the flow of ice over said means independent of mechanical flexing of said surface or maintenance of a water film thereon by the application of heat to said surface from within said structure, whereby the total force against said platform is reduced due in part to the reduction in lateral force caused by ice against said platform.

8. An offshore work platform for use in a body of water upon which ice is formed through natural conditions, comprising:

a base portion positioned in a body of water, means securing said base portion to the underwater bottom, a deck portion supported by said base portion above the surface of said water, a wall section made from low-ice-adhesional material on said base portion and extending from below said surface of said water to above said surface, so as to reduce the total force against said platform by reducing the lateral force caused by ice against said platform without relying on the use of heat transfer between said ice and wall so as to provide a water film between said wall section and said ice and without requiring said wall section to be flexed, said wall section formed converging upwardly and inwardly of said platform in the region of contact of said surface of said water with said wall section and diverging upwardly and outwardly above the region of contact, and constructed to receive and elevate above its natural level a portion of a sheet of ice which moves on said body of water into contact with said wall section.

9. A method for reducing ice forces on a marine structure established in a fixed condition in a body of water which becomes frozen through ambient natural conditions, comprising:

forming a substantially smooth enclosed chamber from a low-ice-adhesional material in said marine structure at a position on said structure at which an exterior surface of a wall portion of said chamber will be in contact with said water and in an area on said structure of potential contact with ice caused by natural freezing of said water, and disposing said exterior surface of said wall portion at an angle inclined to the surface of said water to form a sloping, ramp-like surface to receive and elevate above its natural level an edge portion of a sheet of ice as said sheet of ice moves into contact with said surface, thereby reducing the total force on said structure.

10. A method for reducing ice forces on a marine structure established in a fixed condition in a body of water which becomes frozen through ambient natural conditions, comprising:

forming an enclosed chamber from a low-ice-adhesional material in said marine structure at a position on said structure at which an exterior surface of a wall portion of said chamber will be in contact with said water and in an area on said structure of potential contact with ice caused by natural freezing of said water, disposing said exterior surface of said wall portion at an angle inclined to the surface of said water to form a sloping, ramp-like surface to receive and elevate above its natural level an edge portion of a sheet of ice as said sheet of ice moves into contact with said surface, placing a controllable source of heat in communication with the exterior surface of said chamber, heating the exterior surface of said chamber an amount at least sufficient to cause the temperature of said exterior surface to be above the melting point of natural ice formed in said water adjacent said structure, and controlling the heat of said exterior surface to maintain said temperature above said melting point as said ambient conditions at the location of said structure change, thereby preventing said ice from freezing onto and adhering to said exterior surface, thus reducing the force exerted on said fixed structure by a relative movement of said ice which is in contact with said exterior surface and assisting the ice in slipping over and upon said surface as said movement of said sheet of ice is continued.

11. An offshore work platform for use in a body of water upon which ice is formed through natural conditions, comprising:

a base portion positioned in a body of water, means securing said base portion to the underwater bottom, a deck portion supported in an upright position by said base portion above the surface of said water, a wall section on said base portion and extending from below said surface of said water to above said surface, coating means on said wall section for reducing the adhesion between said coating means and said ice, said wall section formed converging upwardly and inwardly of said platform in the region of contact of said surface of said water with said wall section and diverging upwardly and outwardly above the region of contact, and constructed to receive and elevate above its natural level a portion of a sheet of ice which moves on said body of water into contact with said wall section, a water-tight compartment enclosed within said wall section approximately in horizontal alignment with said region, heating means within said compartment and in heat-transfer relationship with said wall section, and means on said platform for operating said heating means to heat said wall section in said region above the melting point of ice formed in said water and in contact with said wall section, thereby to form a lubricating film of water in the area of contact between said sheet of ice and said wall section.

* * * * *